US008092248B2

(12) United States Patent
Van Stiphout et al.

(10) Patent No.: US 8,092,248 B2
(45) Date of Patent: Jan. 10, 2012

(54) CABLE CLAMP

(75) Inventors: Nico Van Stiphout, Beek en Donk (NL); Peter Poorter, Wijk en Aalburg (NL); Ton Karsmakers, ZD Oss (NL)

(73) Assignee: FCI, Versailles (FR)

( * ) Notice: Subject to any disclaimer, the term of this patent is extended or adjusted under 35 U.S.C. 154(b) by 37 days.

(21) Appl. No.: 12/449,708

(22) PCT Filed: Feb. 22, 2008

(86) PCT No.: PCT/IB2008/001898

§ 371 (c)(1),
(2), (4) Date: Nov. 16, 2009

(87) PCT Pub. No.: WO2008/117182

PCT Pub. Date: Oct. 2, 2008

(65) Prior Publication Data

US 2010/0136822 A1 Jun. 3, 2010

(51) Int. Cl.
*H01R 13/58* (2006.01)

(52) U.S. Cl. ..... 439/464; 439/470

(58) Field of Classification Search ..... 439/449–473
See application file for complete search history.

(56) References Cited

U.S. PATENT DOCUMENTS

| | | | | |
|---|---|---|---|---|
| 4,169,648 | A * | 10/1979 | Moist, Jr. | 439/467 |
| 4,280,746 | A * | 7/1981 | Ignatowicz | 439/470 |
| 4,596,432 | A * | 6/1986 | Tighe, Jr. | 439/466 |
| 5,645,447 | A | 7/1997 | Sandor | 439/467 |
| 5,921,806 | A * | 7/1999 | Shuey | 439/464 |
| 6,250,972 | B1 * | 6/2001 | Shinchi et al. | 439/752 |
| 6,623,303 | B2 * | 9/2003 | Syed et al. | 439/607.44 |
| 7,201,604 | B1 * | 4/2007 | Amidon | 439/469 |

FOREIGN PATENT DOCUMENTS

| | | |
|---|---|---|
| DE | 297 17 805 U1 | 1/1998 |
| DE | 100 15 842 C1 | 2/2002 |

* cited by examiner

*Primary Examiner* — Truc Nguyen
(74) *Attorney, Agent, or Firm* — Harrington & Smith

(57) ABSTRACT

The invention concerns a Cable clamp for a cable connector, the cable clamp being arranged for receiving and capturing a portion of at least one cable extending along an extension direction from the connector. The cable clamp includes a first section and a plurality of second sections which are movably attached or attachable to the first section; the first section includes at least one through-hole extending in the direction of extension, which through-hole is configured for receiving a first portion of at least one cable penetrating through the hole and at least a portion of the second sections is arranged for capturing between them a second portion of the at least one cable penetrating through the hole and extending therefrom.

13 Claims, 3 Drawing Sheets

CABLE CLAMP

FIELD OF THE INVENTION

The present invention relates to a cable clamp for a cable connector. The invention further relates to a cable connector comprising such a cable clamp.

BACKGROUND OF THE INVENTION

In a cable connector, in particular an electrical cable connector, it should generally be prevented that mechanical forces on the cable attached to the connector, such as stress and strain from pulling and/or bending, are transmitted to the interior parts and connections of the connector to protect them from damage. It is therefore known to provide a cable connector with a cable clamping structure for anchoring the cable to the connector housing limiting such transmission of forces from a freely movable portion of the cable further towards more delicate parts such as soldered connections.

On the one hand, a cable clamp should provide sufficient clamping force for holding the cable against the various forces, favouring a tight clamp. On the other hand, the cable clamp should be mountable to the cable relatively easily. In the past, these conflicting demands have been met by forming the clamp from a plurality of separate parts which should be assembled to form a clamping structure, one of which parts possibly being a part of a connector cover.

However, it has been found that the divide between parts of the cable clamp forms an inherent weak spot in a cable connector. In some cases, a pulling force on the cable could even force open a connector cover comprising a plurality of parts and thus exposing a portion of the interior of the connector. This is undesired and may even lead to dangerous situations, e.g. when the cable carries high power electric voltages and/or currents.

Furthermore, the continuous desire for reducing both the size and the manufacturing costs of connectors substantially prevents increasing the dimension of parts for increasing their strength.

Consequently, there is a desire for an improved cable clamping arrangement for a connector.

SUMMARY OF THE INVENTION

An aspect of the invention is a cable clamp for a cable connector, the cable clamp being arranged for receiving and capturing a portion of at least one cable extending from the connector. The cable damp comprises a first section and a plurality of second sections which are movably attached or attachable to the first section, e.g. with hinges. The first section comprises at least one through-hole having a direction of extension, which through-hole is configured for receiving a first portion of at least one cable penetrating through the hole. At least a portion of the second sections is arranged for capturing between them a second portion of the at least one cable penetrating through the hole and extending therefrom.

Such a cable clamp provides a generally closed structure around the cable, by means of the first section, while the second sections capture the cable. In a cable connector the first section may be arranged towards a side of a connector from which the cable extends. Thus, the inherent weakness of the divide of prior art cable damps is substantially prevented.

Major part of pulling force that would be applied on the cable is recovered at first by the first section which therefore reduces the risk of disengagement of the second sections.

The through-hole in the first section of the cable damp may be sized for threading it onto the cable relatively easily, facilitating assembly of the connector.

The first section may be provided with strain relief features for reducing bending strain, such as a resilient extension substantially defining a minimum bending radius for one or more cables.

In the connector of claim 2 one or more cables may be fed through the first section and be clamped individually or in one or more groups between the same portion of the second sections. This is for instance useful for aligning a number of cables to other parts of the connector, e.g. contact terminals. Alternatively, a plurality of cables may be fed through a plurality of holes, wherein several cables are fed through the same through-hole. In the latter case, the hole may be configured for individually positioning individual cables within the same holes.

In the connector of claim 3, the holes are neatly arranged, e.g. for facilitating connecting contact terminals thereto or for reducing the thickness of the connector.

In the connector of claim 4 the cable damp may be designed relatively simple and the cable or cables may be efficiently clamped. The orientation of the second sections may correspond to that of the cover portions of the connector; the first section substantially provides a frame around the cable or cables and substantially prevents the cable(s) to inadvertently being pulled out of the cable damp wholly or partially and to open portions of a surrounding cover. The second portion may be configured for individually positioning individual cables to a certain degree, e.g. corresponding to the hole(s) of the first section and/or for aligning the cables with respect to other parts of the connector.

The cable clamp of claim 5 provides for a relatively reliable anchoring of the cable clamp to the connector housing portion and therewith for anchoring a captured and damped cable to the connector housing portion.

In the connector of claim 6, the cable clamp may be anchored or fixed relatively reliably to a connector housing part by the fastener. The fastener may also serve for damping the cable clamp to a cable. The fastener may be a fastener configured for fastening a number of connector housing portions such as covers together.

In the connector of claim 7, the passageway is arranged for positioning the fastener for reliably anchoring the cable clamp. The position of the passageway may further provide a substantially even clamping force to the second sections of the cable damp and one or more cables clamped thereby.

In the connector of claim 8, the passageway is arranged for positioning the fastener such that it may provide a damping force for at least two adjacent cables. The passageway may be arranged substantially symmetrical with respect to the cables and possibly with respect to the cable clamp as a whole.

The connector of claim 9 provides a relatively high holding force of the cable clamp for substantially reliably fixing one or more cables with respect to the cable clamp and therewith to a connector portion to which the cable damp may be anchored. Suitable retention structures are ribs, dimples, protrusions etc. and/or combinations thereof. The first section being substantially free from retention structures facilitates threading the cable damp to a cable. It also allows the through-holes to fit relatively tightly around one or more cables, providing a guiding functionality thereto and possibly assisting defining a minimum bending radius of a cable.

In the connector of claim 10, the cables are especially strongly held against pulling forces on a cable, e.g. rendering a connector comprising such a cable damp relatively robust against unmating by pulling on one or more cables instead of on the connector housing, or against accidental pulling such as when the cable damp is fixed, e.g. in a connector which is screw-tightened to a counterconnector or a device housing. Forces pushing the cable in a direction from the first section towards the second sections may increase a free cable portion extending from the second sections, e.g. into a connector interior. Such forces may be considered less damaging and require less protection.

The connector of claim 11 may be manufactured relatively cost effectively, e.g. by molding. The cable damp, be it a one-piece member or an assembly, may be of any suitable material, but a low-cost insulating material such as a plastics material is preferred. The material may be somewhat flexible and/or resilient for increasing absorbance of the material against forces on the cable. A relatively rigid material may also be used, e.g. when a relatively robust connector is desired.

The connector of claim 12 is relatively reliable. The support structure mitigates the effects of a relatively high pulling force on a damped cable in a direction from the second sections towards the first section. This may lead to a too high bending radius of the hinge members leading to damage. The support structure can limit the bending to an acceptable degree. The support structures also mitigate a too high clamping force of a fastener, connector covers or other clamping means on the second sections, which also may damage hinges between the first section and the second sections. Furthermore, the support structures may also protect the cable against being pressed too hard or even being crushed by the cable clamp.

Another aspect of the invention is a cable clamp for a cable connector, the cable clamp being arranged for receiving and capturing a portion of a plurality of cables extending from the connector. The cable clamp is a one-piece member comprising a first section and a two second sections which are movably attached substantially opposite each other to the first section. The first section comprises a plurality of through-holes having a direction of extension, which through-holes are configured for receiving a first portion of at least one cable penetrating through a through-hole. At least a portion of the second sections is arranged for capturing between them a second portion of the at least one cable penetrating through a through-hole and extending therefrom.

The cable clamp may be manufactured relatively efficiently, being a one-piece member. The cable clamp may be threaded on a cable with the first section and be captured and clamped with the second sections. The first section provides a substantially closed frame around one or more cable or cables, preventing them from being pulled out therefrom. Therewith, the cable clamp may prevent covers of a connector to be pulled open by a pulling force on one or more cables. The first and second sections being attached allows to determine a suitable relative position thereof.

Another aspect is a cable clamp for a cable connector, the cable clamp being arranged for receiving and capturing a portion of a plurality of cables extending from the connector. The cable clamp is a one-piece member comprising a first section and a two second sections which are movably attached substantially opposite each other to the first section. The first section comprises a plurality of through-holes having a direction of extension, the directions of extension of the through-holes being arranged in a direction substantially parallel to each other in a first plane. The through-holes are configured for receiving a first portion of at least one cable penetrating through a through-hole. At least a portion of the second sections is arranged for capturing between them a second portion of the at least one cable penetrating through a through-hole and extending therefrom. The cable clamp comprises a passageway for receiving at least a portion of a fastener extending in a direction substantially perpendicular to the first plane and in-between two through-holes.

Such a cable clamp allows to capture and clamp a plurality of cables with a single, one-piece clamp, which may be suitably anchored to a connector portion. The cables being surrounded by the first section substantially prevents the cables from being pulled out of the cable clamp sideways and possibly opening two connector covers, exposing the interior.

A cable connector comprising a cable damp as described above and defined in claim 15 is relatively robust. The connector defined in claim 16 may comprise two cover portions exerting a damping force on the cable clamp. The force may be derived from one or more fasteners.

The invention will hereafter be fully explained with reference to the drawings showing an embodiment of the invention by way of example.

DETAILED DESCRIPTION OF THE EMBODIMENTS

Figure 1:
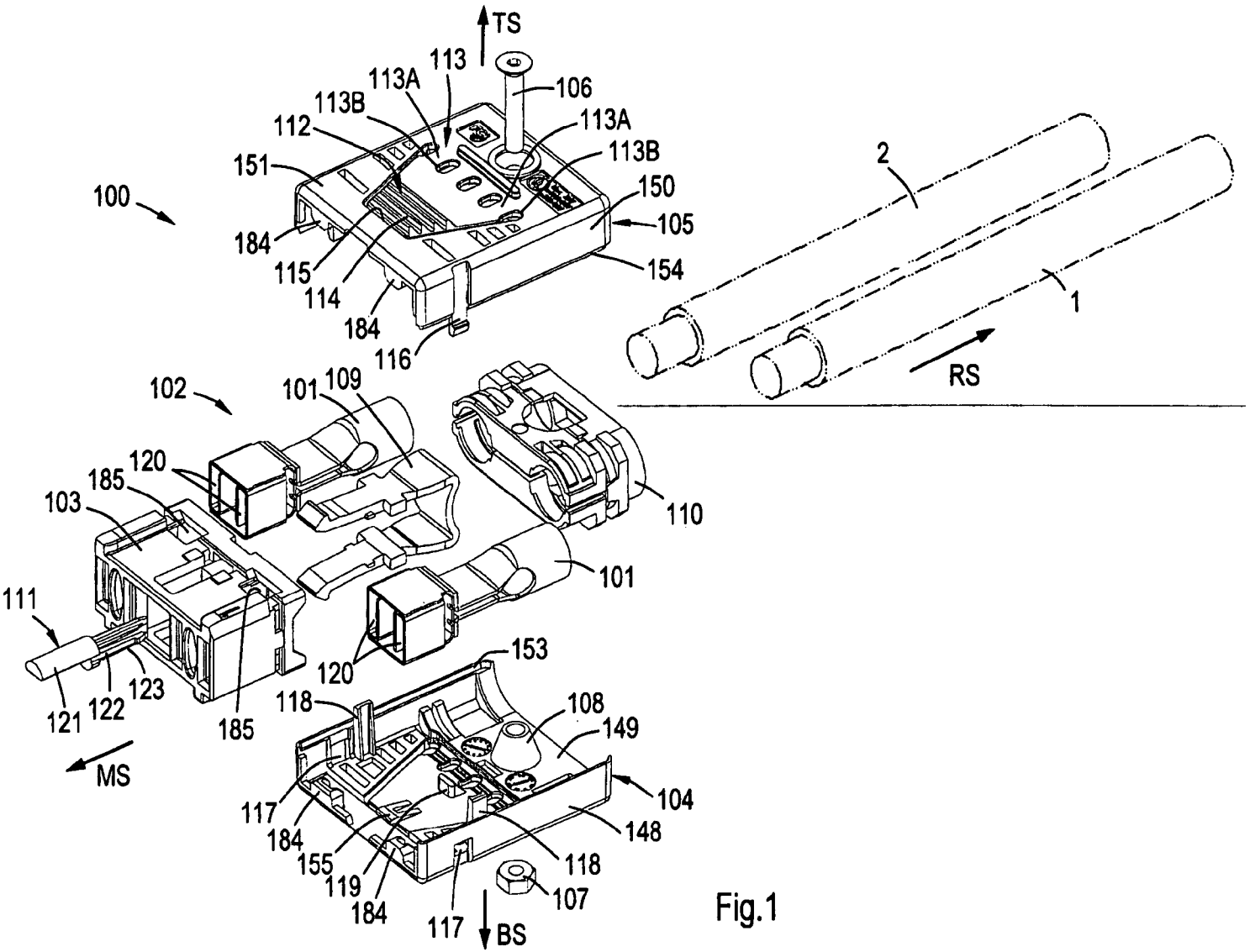
FIG. 1 is an exploded perspective view of a connector.

Referring to FIG. 1, there is shown an exploded perspective view of an electrical connector 100 incorporating features of the invention. Although the invention will be described with reference to the exemplary embodiments shown in the drawings, it should be understood that the invention can be embodied in many alternate forms of embodiments. In addition, any suitable size, shape or type of elements or materials could be used. Further, elements and/or aspects discussed with respect to one embodiment may be suitably combined with those of another embodiment.

FIG. 1 shows a straight cable plug connector 100, adapted for mating with a receptacle mating connector such as a board connector. The connector 100 generally has a front side or mating side MS, a rear. side RS, a top side TS and a bottom side BS, the directions being indicated with arrows.

In the following, substantially corresponding or identical parts and portions of different embodiments are indicated with substantially the same reference numerals.

It should be noted that definitions of orientations and/or sides are mainly for ease of reference and correspond to the parts as shown in the Figures, they should not be construed limiting the disclosure.

The electrical connector 100 is a power connector adapted to removably connect electrical conductors 1, 2 to another electrical connector. The electrical connector 100 generally comprises electrical contacts 101, a housing 102 including a terminal housing 103 and covers 104, 105, fasteners 106, 107, which are accommodated in fastener conduits 108, a locking spring 109, a strain relief 110, and a coding key 111.

In the shown embodiment, the fasteners 106, 107 are a screw bolt 106 and a corresponding nut 107. Other fasteners may be envisioned.

The bottom cover portion 104 comprises lateral side walls 148 and a bottom wall 149. The top cover portion comprises lateral side walls 150 and a top wall 151. Along the facing edges of the covers 104, 105, the cover 104 comprises a collar 153 and the cover 105 comprises a collar 154.

The cover portions 104 and 105 of the connector 100 comprise deflectable latch portions 112 with a rear end or base 113, and with finger gripping structures 114 and a front end 115 with an inside ledge 155. The base 113 comprises base portions 113A and holes 113B. The connector 100 further comprises structures for snap locking the covers 104 and 105 to each other in the form of snap lock latches 116, corresponding reception apertures 117 and supporting ribs 118.

On the interior side of the covers 104, 105 protrusions 119 are provided for supporting the locking spring 109 as will be explained below. Additional protrusions 184 are arranged for being received in holes 185 in the terminal housing 103, as will be explained below with respect to FIG. 47.

The shown contact terminals or contacts 101 are configured for receiving an electrical conductor 1, 2 and for being crimped thereto. The contacts 101 are female contacts, each having two substantially parallel contact receiving sections 120 for receiving male contacts of a mating connector, e.g. contact pins or blades.

The orientation of the coding key 111 with respect to the terminal housing 103 may determine correct mating between the connector 100 and a mating connector. The coding key 111 has a front keying portion 121, an intermediate portion 122 and a rear mounting portion 123 arranged along a longitudinal axis.

The connector 100 in this embodiment is a straight connector and the conductors 1, 2 extend from the rear side RS of the connector 100. However, features of the invention could be used in a right angle connector. Features of the invention could also be used in a signal connector or a combined signal and power connector. The invention can be used in a "high power" input/output (IO) system, such as 100 Amperes by 20 DC Volts or 25 Amperes by 80 DC Volts for example. The design can use PWR BLADE® contacts (such as those described in U.S. Pat. No. 7,309,242).

A general trend is higher current carrying capacity per pin in order to meet high density and still be able to supply high currents to the various components within a system. 2000 Watts at 100 Amperes is not an unusual requirement. The board connector can have four generic PWR BLADE® contacts to drive the positive and negative poles of the power (2 contacts per pole) and can have a dedicated housing to provide a robust I/O connector system with touch-proof walls and coding in at least four orientations, e.g. defined by a coding key.

Figure 2:
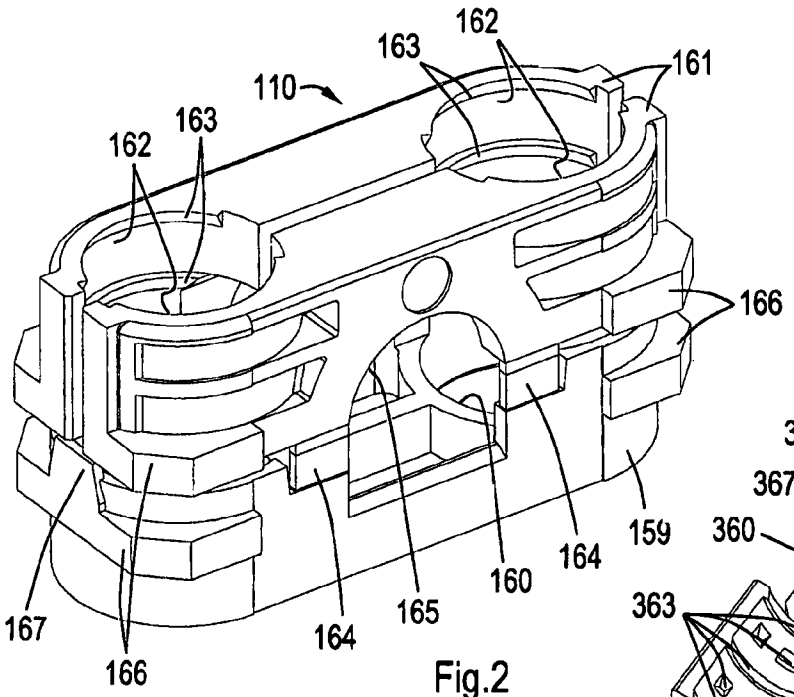

Referring also to FIGS. 1 and 2 the cable clamp or strain relief member 110 is arranged for receiving and capturing a portion of at least one cable extending along a direction of extension from the connector, here being adapted to be mounted onto the insulation of the two electrical conductors 1, 2 and to be captured between the covers 104, 105 with a portion of the fastener 106 and a portion of the fastener conduits 108, passing through the strain relief member 110. The strain relief member 110 is preferably a one piece member made of plastic or polymer material, but it may also be a compound member, comprising a plurality of constituent parts. The strain relief 110 has a first section 159 with two holes 160 for the conductors 1, 2 and two second sections 161. As shown in FIG. 1, in use the first section is located at the rear side of the connector, while the second sections are positioned forwardly in respect to the first section towards the mating side. The holes 160 are through holes, for fully enclosing cables 1, 2 penetrating through the first section 159. The second sections 161 are arranged for capturing between them a second portion of the cables 1, 2 penetrating through the holes 160 and extending therefrom. The second sections 161 are generally mirror images of each other. Each second section 161 has two semi-channel grooves 162, provided with profile structures 163, here in the form of ribs 163. The ribs are asymmetric, providing an higher retention force against pulling forces on a conductor in a direction from the second sections 161 towards the first section 159 than in the opposite direction. Two living hinges 164 are provided to movably attach each second section 161 to opposite sides of the first section 159. The strain relief has holes 165 between the first section 159 and each second section 161 and in-between the two structures 160, 162 for receiving the conductors 1, 2. In the situation of FIG. 2, the holes 165 form a passageway for the fastener 106 and the fastener conduits 108. After the conductors 1, 2 are inserted into the strain relief 110, the second sections 161 can be folded up to capture the cables or conductors 1, 2 between the second sections 161. The second sections 161 can be damped towards each other by the covers 104, 105. The first section 159 remains stationary to fixedly, interlockingly mount the strain relief member 110 between the covers 104, 105. The holes 160 and the facing semi-channel grooves 162 of the opposite sections 161 thus form damping and guiding passageways for a conductor 1, 2 through the strain relief 110.

For increasing the anchoring hold of the covers 104, 105 on the strain relief 110 and better fixing these parts and one or more clamped conductors together, the strain relief is provided with a profile structure on its exterior such as a number of ribs 166 (of which only some are indicated). The covers 104, 105 may comprise a matching profile structure.

Figure 3:
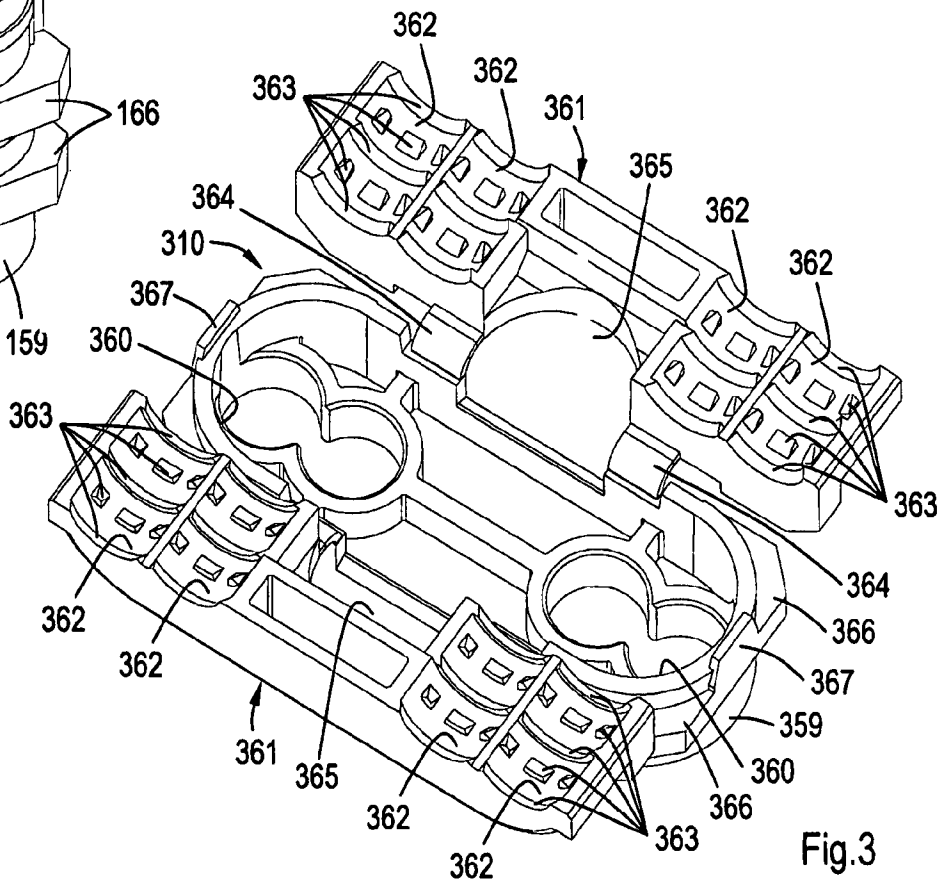
FIGS. 2 and 3 show embodiments of a strain relief.

FIG. 3 shows a similar strain relief member 310 to the one shown in FIG. 2, but for four conductors; two conductors each side-by-side.

The strain relief member 110, 310 may be molded from a relatively rigid material. The strain relief and the mold may be designed such that a relatively simple, two-part mold suffices.

In a one-piece strain relief 100, 310, the living hinges 164, 364 form a relative weak portion. In particular when a conductor 1-4 is pulled repeatedly in a direction from the mating side MS towards the rear side RS of the connector the hinges 164 may be subjected to repeated bending and/or flexing, resulting in material fatigue, damaging and possibly failure of one or more hinges. For limiting such bending, support structures 167, 367 are provided to the first sections 159, 359, which support the second sections 161, 361. The support structures 167, 367 may also limit a clamping force of the covers 104, 105 (304, 305) onto the strain relief 110, 310.

Figure 4:
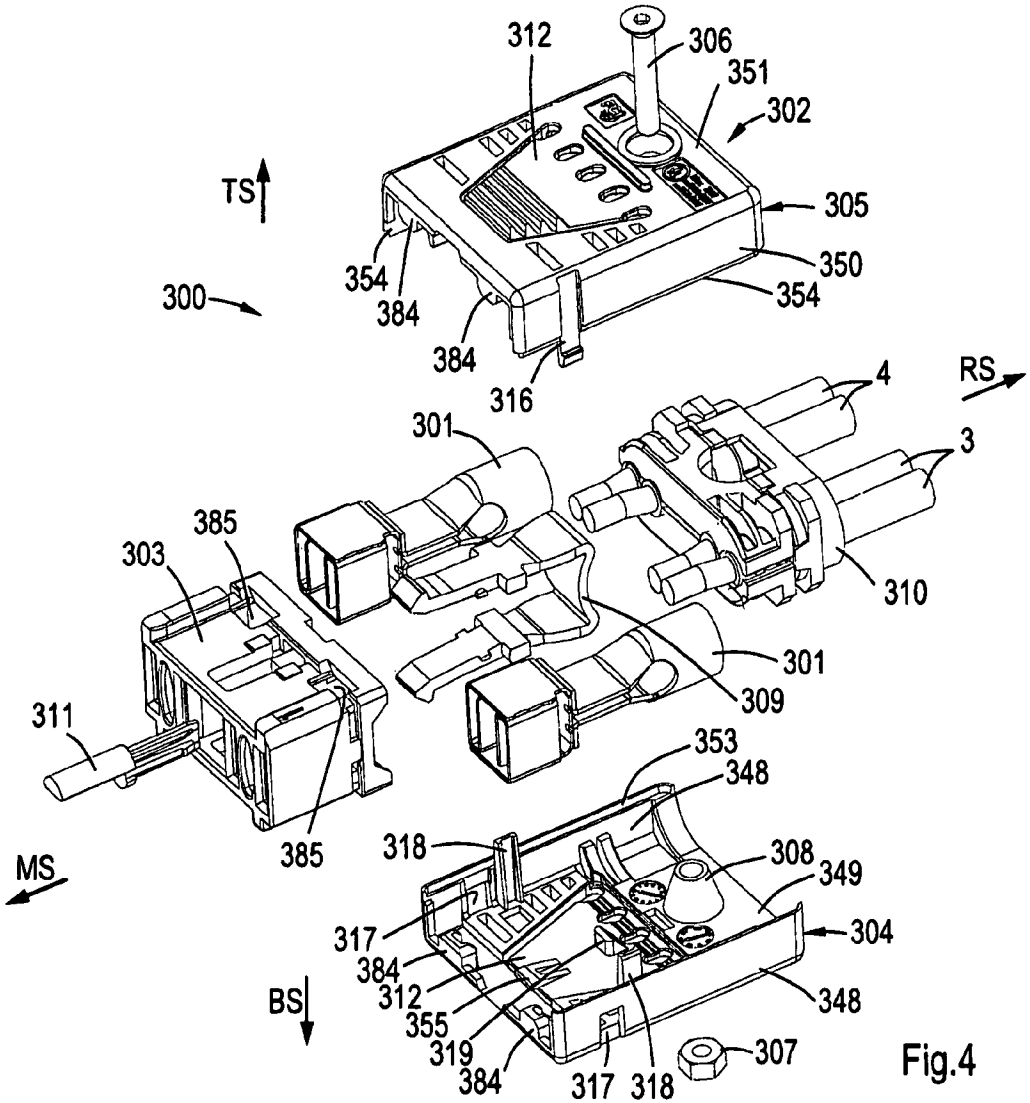
FIG. 4 is an exploded perspective view of a straight connector.

In FIG. 4 there is shown an exploded perspective view of an electrical connector 300 incorporating features of the invention. Apart from being adapted for use with four conductors 3, 4, instead of two conductors 1, 2, the connector 300 is substantially identical to the connector 100 of FIG. 1, as has been pointed out before. In the connector 300, each contact 301 accommodates the conducting portions of two conductors 3, 4 emerging from the strain relief 310. The conductors 3, 4 each have a smaller cross section than the conductors 1, 2. However the cross section of two conductors 3 or 4 together may be equal to or bigger than that of a conductor 1, 2, such that an equal or larger power may be conducted per contact, whereas the conductors 3, 4 are more flexible and may transmit larger electrical currents and/or powers since their combined surface area is higher, facilitating cooling of the conductor.

In FIG. 4, the strain relief member 310 is shown capturing the cables 3, 4.

Comparing FIGS. 3 and 4, it can be seen that, from the rear side RS towards the mating side MS, the conductors or cables 3, 4 first penetrate the first section 359, next are damped by the second sections 361 and then extend from the strain relief towards the contacts 301.

A connector for more than four conductors can be envisioned, as well as a connector wherein two or more contacts are connected to different numbers or types of conductors, which may all be captured in a single strain relief.

As discussed above, with the invention, a cable damp 110 (310) with a rigid frame provided by the first section 159 (359) to keep the cables 1, 2 (3, 4) in position can be provided. To prevent that movement of the cables 1, 2 (3, 4) could open the cover halves 104, 105 (304, 305), a rigid frame was designed which would enclose the cables and in doing so limit their freedom. The hinges keep the clamping features 163 (363) away from the cable 1, 2 (3,4) and so improve the easiness to assembly the cable connector 110 (310) to the cable, as the clamping will only occur at the very end of the assembly when the covers 104, 105 (304, 305) are fastened, e.g. screw tightened. To maximize the retention force provided by the damping features the single screw location 165 (365) has been placed right in the middle of the cables 1, 2 (3, 4).

It should be understood that the foregoing description is only illustrative of the invention. Various alternatives and modifications can be devised by those skilled in the art without departing from the invention.

The invention claimed is:

1. Cable clamp for a cable connector, the cable clamp being arranged for receiving and capturing a portion of at least one cable extending along an extension direction from the connector, wherein the cable clamp comprises a first section and a plurality of second sections which are movably attached or attachable to the first section, wherein the first section comprises at least one through-hole extending in the direction of extension, which through-hole is configured for receiving a first portion of at least one cable penetrating through the hole, where the at least one through-hole is configured to have the at least one cable extend entirely through the first section such that the at least one cable extends beyond front and back sides of the first section from the through-hole, wherein at least a portion of the second sections is arranged for capturing between them a second portion of the at least one cable penetrating through the hole and extending therefrom and wherein the cable clamp further comprises a passageway for receiving at least a portion of a fastener extending in a direction which is substantially perpendicular to the direction of extension of the one or more through-holes.

2. Cable clamp according to claim 1, being configured for receiving and capturing a plurality of cables, wherein the first section comprises a plurality of through-holes, the through-holes being configured for receiving a first portion of a cable penetrating through a hole.

3. Cable clamp according to claim 1, wherein the cable clamp comprises two second sections arranged substantially opposite each other and being configured for capturing between them a second portion of one or more cables penetrating through one or more through-holes in the first section and extending therefrom.

4. Cable clamp according to claim 1, comprising one or more retention structures for cooperating with a portion of a connector housing for substantially fixing the cable clamp to the housing portion.

5. Cable clamp according to claim 1, wherein at least a portion of the second sections is provided with a number of retention structures for holding a portion of a cable and the first section is substantially free of such retention structures.

6. Cable clamp according to claim 1, being a one-piece member.

7. Cable clamp according to claim 1, wherein the first section and the second sections are connected with hinge members and wherein the cable clamp comprises at least one support structure for supporting at least a portion of a first and a second section with respect to each other.

8. Cable connector comprising a cable clamp according to claim 1.

9. Cable clamp according to claim 2, wherein the directions of extension of the through-holes are arranged in a direction substantially parallel to each other in a first plane.

10. Cable clamp according to claim 9 wherein the passageway is arranged in-between the first section and the second sections.

11. Cable clamp according to claim 10, wherein the passageway extends substantially perpendicular to the first plane and wherein the passageway is arranged in-between two through-holes.

12. Cable clamp for a cable connector, the cable clamp being arranged for receiving and capturing a portion of at least one cable extending along an extension direction from the connector wherein the cable clamp comprises a first section and plurality of second sections which are movably attached or attachable to the first section, wherein the first section comprises at least one through-hole extending in the direction of extension, which through-hole is configured for receiving a first portion of at least one cable penetrating through the hole, wherein at least portion of the second sections is arranged for capturing between them a second portion of the at least one cable penetrating through the hole and extending therefrom and wherein the cable clamp further comprises a passageway for receiving at least a portion of a fastener extending in a direction which is substantially perpendicular to the direction of extension of the one or more through-holes, wherein at least a portion of the second sections is provided with a number of retention structures for holding a portion of a cable and the first section is substantially free of such retention structures, wherein at least a portion of the retention structures is formed for providing a biased retention force on a cable captured between the second sections, the biased retention force providing a relatively higher retention force against a force on the cable in a direction from the second sections towards the first section than against a force on the cable in the direction from the first section towards the second sections.

13. Cable connector comprising a cable clamp and a housing, where the cable clamp comprises a first section and a plurality, of second sections which are movably attached or attachable to the first section, wherein the first section comprises at least one through-hole extending in the direction of extension, which through-hole is configured for receiving a first portion of at least one cable penetrating through the hole, wherein at least a portion of the second sections is arranged for capturing between them a second portion of the at least one cable penetrating through the hole and extending therefrom and wherein the cable clamp further comprises a passageway for receiving at least a portion of a fastener extending in a direction which is substantially perpendicular to the direction of extension of the one or more through-holes;

where the housing has at least two cover portions and the cable clamp being arranged at least partially in the housing, wherein the cover portions of the connector housing are arranged for receiving at least a portion of the first section and a portion of the second sections of the cable clamp and for clamping the portion of the second sections onto the cable.

* * * * *